US005695147A

United States Patent [19]

Zimmerman

[11] Patent Number: 5,695,147

[45] Date of Patent: Dec. 9, 1997

[54] LENGTH CONTROLLER FOR FLEXIBLE LINE AND METHOD OF USE

[76] Inventor: Harry I. Zimmerman, 310 Comstock Ave., Los Angeles, Calif. 90024

[21] Appl. No.: 328,840

[22] Filed: Oct. 25, 1994

[51] Int. Cl.[6] ..... B65H 75/34

[52] U.S. Cl. ..... 242/388.3; 254/223

[58] Field of Search ..... 242/388.1, 388.2, 242/388.3, 388.4, 378.2, 378.3; 254/213, 223

[56] References Cited

U.S. PATENT DOCUMENTS

| | | | |
|---|---|---|---|
| 696,510 | 4/1902 | Still | 242/396.4 |
| 769,695 | 9/1904 | Gurr | 248/492 |
| 862,011 | 7/1907 | Patrick et al. | 242/379.2 |
| 3,251,569 | 5/1966 | Rynearson | 248/31 |
| 3,330,525 | 7/1967 | Weinstein | 248/496 |
| 4,364,538 | 12/1982 | Tomlinson | 248/495 |
| 4,566,665 | 1/1986 | Rynearson | 248/495 |
| 4,662,632 | 5/1987 | Bjorhn | 273/73 |
| 4,841,649 | 6/1989 | Baggio | 36/117 |
| 5,125,389 | 6/1992 | Paff | 124/86 |

*Primary Examiner*—Katherine Matecki
*Attorney, Agent, or Firm*—Blakely Sokoloff Taylor & Zafman

[57] ABSTRACT

A length controller (20) and method of use for adjusting the effective length of a flexible line (23), wherein the flexible line (23) is fixed at both ends and is used for hanging objects such as pictures (62), mirrors, and the like from a wall or other supporting structure. The controller (20) comprises a body (22) having first and second line engaging means. A rotor (24) is rotatably connected to the body (22), and has a first line receiving slot (26). A ratcheting means permits the rotor (24) to rotate in one direction only relative to the body (22). The flexible line (23) is inserted into first and second line engaging means (28, 30) and the first line receiving slot (26). The rotor (24) is then turned to decrease the effective length of the flexible line (23). A ratchet disengaging means releases the ratchet means and enables an increase in the effective length of the flexible line (23).

4 Claims, 6 Drawing Sheets

FIG. 1
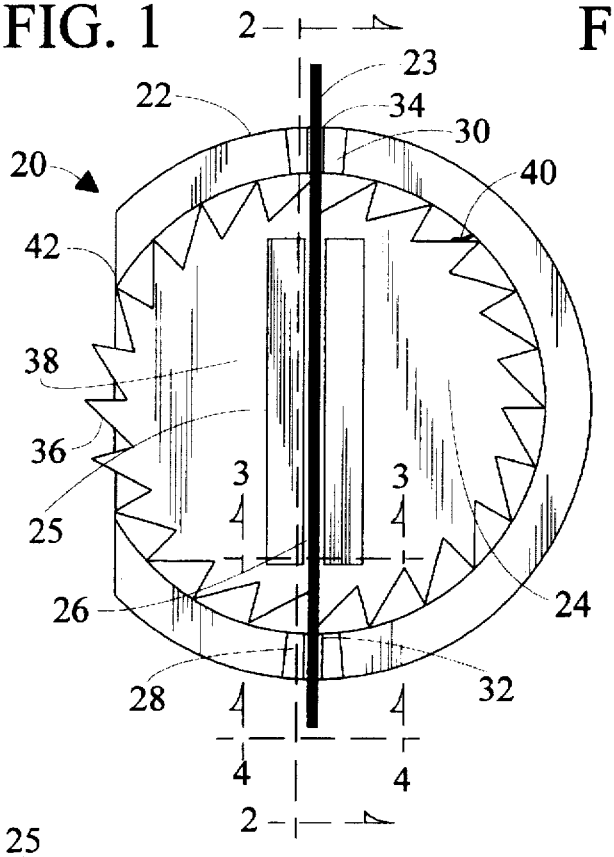
FIG. 2
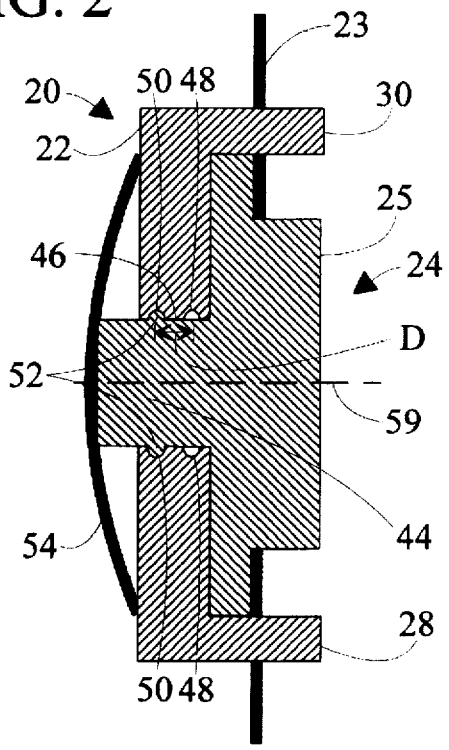
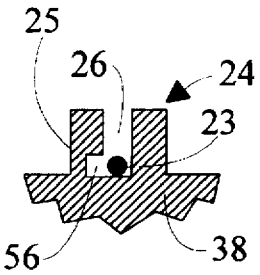
FIG. 3
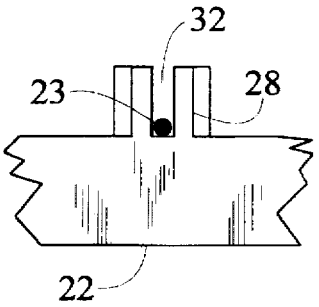
FIG. 4
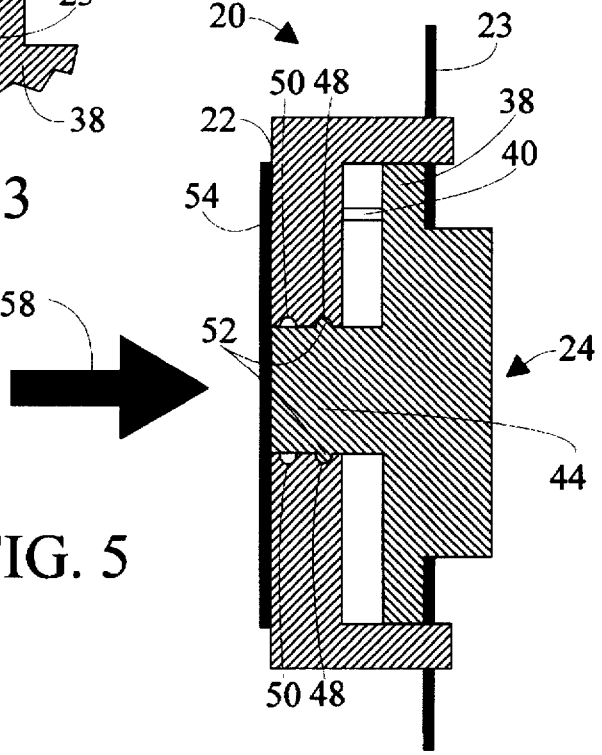
FIG. 5

FIG. 6
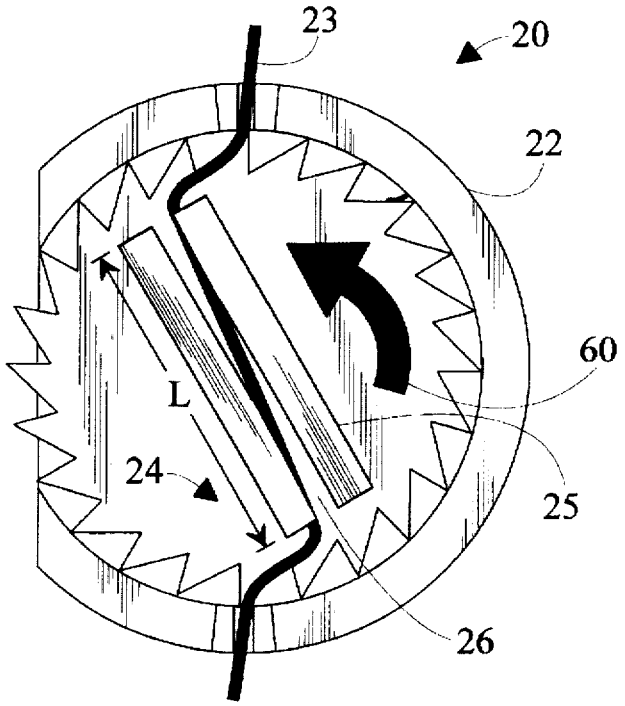
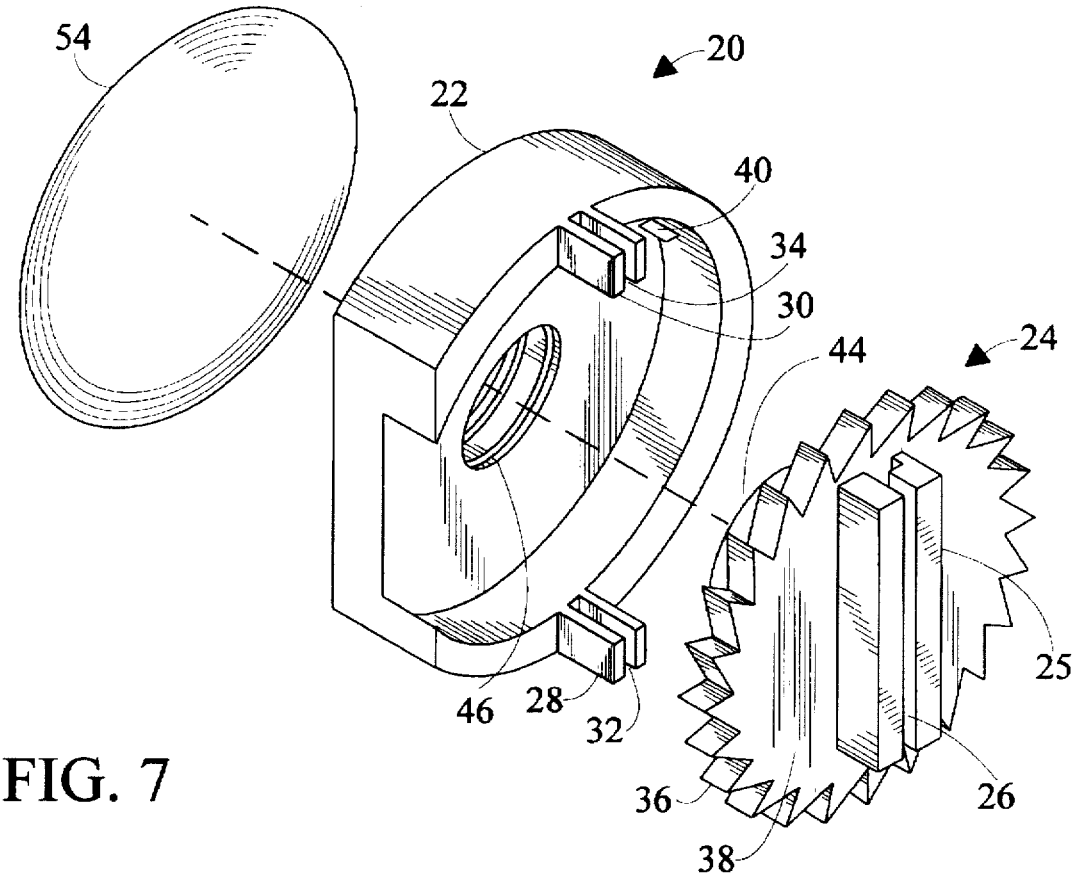
FIG. 7

LENGTH CONTROLLER FOR FLEXIBLE LINE AND METHOD OF USE

TECHNICAL FIELD

The present invention pertains to a length controller and method of use for adjusting the effective length of a flexible line, wherein the flexible line is fixed at both ends and is used for hanging objects such as pictures, mirrors, and the like from a wall or other supporting structure.

BACKGROUND ART

Devices for hanging pictures have been known in the art for many years. Typically these devices attach to the picture frame or the wall and provide the user adjustment control of the height and/or horizontal inclination of the picture. For example, U.S. Pat. No. 696,510 shows a frame mounted picture hanger which utilizes a ratchet and pawl to wrap the wire or picture cord around a spool. U.S. Pat. No. 769,695 defines a picture hanging device employing two frame mounted ratchet assemblies having windlasses. By virtue of the two assemblies, the height and/or the horizontal inclination of the picture can be adjusted without moving the central support point of the picture wire. U.S. Pat. No. 862,011 depicts a frame mounted picture hanger having a pulley, a ratchet, and a dog arrangement for adjusting the effective length of the picture cord or wire. U.S. Pat. Nos. 3,251,569 and 4,566,665 disclose wall mounted adjustable hangers wherein a slide block and threaded shaft vary the amount of folding of the picture wire to control the available effective length between the sides of the frame. U.S. Pat. No. 3,330,525 shows a circular wall mounted picture hanger assembly which fits around the existing supporting member (nail). The assembly has a spiral shaped slot which, when the assembly is turned, adjusts the height of the picture. U.S. Pat. No. 4,364,538 describes a frame mounted adjustable cable picture hanging system for use with a cable of limited stiffness. The system uses a locking aperture to crimp a portion of the cable and therefore reduce the cable's effective length. U.S. Pat. Nos. 5,125,389, 4,662,632, and 4,841,649 show a tensioning apparatus for compound bows, a string tensioning device for use on rackets for ball games, and a locking and adjustment device particularly for ski boots, respectively, and are included for general reference.

All of the aforestated picture hanging devices require special, and usually time consuming, attachment to either the picture frame or the supporting structure. They further require that the picture must be removed from the supporting structure during the installation process.

DISCLOSURE OF INVENTION

The present invention is directed to an improved length controller and method for adjusting the effective length of a flexible line, wherein the flexible line is fixed at both ends and is used for hanging objects such as pictures, mirrors, and the like from a supporting structure. The present invention is particularly useful in that it attaches directly to the flexible line and therefore does not require attachment holes or adhesive to be applied to the object or supporting structure, thus avoiding potential blemishing. Further the present invention does not require the use of any mounting hardware or other ancillary devices, and installation and use can consequently be effected in a minimum timeframe. The present invention can be used to conveniently alter the height or horizontal inclination of any hanging object without necessitating removal of the object from the supporting structure. Further, in that the present invention neither attaches to the hanging object nor the supporting structure, the invention can readily be employed in situations where attachment to the object or supporting structure would be impractical or impossible (e.g. a picture having a narrow frame)

In accordance with a preferred embodiment of the invention, the length controller has a body with first and second line engaging means for holding and guiding the flexible line. A rotor having a housing and a line receiving slot is rotatably connected to the body. A ratcheting means operating between the body and the rotor permits the rotor to rotate in one direction only relative to the body.

In accordance with an important aspect of the invention, the first and second line engaging means include peripherally opposed limbs, each of the limbs also having line receiving slots or notches to engage the flexible line.

In accordance with an important aspect of the invention, the ratcheting means includes a plurality of peripheral ratchet teeth forming a ratchet wheel, and a cooperating pawl. The ratchet wheel can be integral with the rotor and the pawl integral with the body, or conversely the ratchet wheel can be integral with the body and the pawl integral with the rotor.

In accordance with another important aspect of the invention, the line receiving slots have widths, the widths selected from a plurality of varying widths so as to accommodate flexible lines of varying sizes. Similarly, line receiving notches or hooks can also be of varying sizes.

In accordance with another important aspect of the invention, a fourth line receiving slot is oriented perpendicular to and intersects the first line receiving slot to form an L shape, so that the flexible line tends to be captured within the fourth line receiving slot as the rotor is turned and line tensioning force is applied.

In accordance with an important feature of the invention, a ratchet disengaging means for disengaging the ratcheting means and permitting the rotor to rotate in either direction relative to the body is provided. Activation of the ratchet disengaging means causes the pawl to be disengaged from the ratchet wheel thus releasing the line tensioning force from the flexible line.

In accordance with a preferred embodiment of the invention, the flexible line is inserted into the first and second line engaging means, and the line receiving slot. The rotor is turned in the one direction permitted by the ratcheting means and a tensioning force is applied to the flexible line causing the line to effectively shorten as the line starts to wind around the rotor housing. When the rotor is released, the ratcheting means holds the flexible line in its shortened configuration. To release the tensioning force, the ratchet disengaging means is activated.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 1 is a front view of the length controller in accordance with the present invention;

FIG. 2 is a cross section view of the length controller along the line 2—2 of FIG. 1;

FIG. 3 is a fragmented cross section view of the first line receiving slot and the ratchet wheel along the line 3—3 of FIG. 1;

FIG. 4. is a fragmented view of the first line engaging means along the line 4—4 of FIG. 1;

FIG. 5 is a cross section view of the length controller along the line 2—2 of FIG. 1 showing activation of the ratchet disengaging means;

FIG. 6. is a front view of the length controller showing the rotor turned to apply tensioning force on the flexible line;

FIG. 7 is an exploded view of the length controller;

MODES FOR CARRYING OUT THE INVENTION

Figure 8:
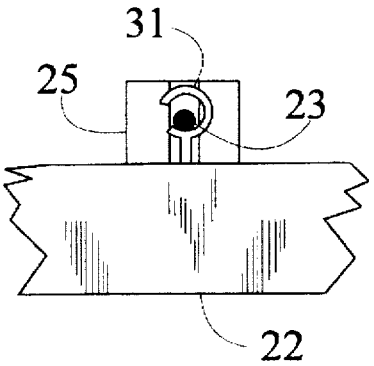
FIG. 8 is a fragmented view of a second embodiment of the first line engaging means, viewed in the same direction as FIG. 4.

Referring initially to FIG. 1 and FIG. 7, there are illustrated front and exploded views respectively of a length controller in accordance with the present invention, generally designated as 20. The length controller 20 consists of a substantially disc shaped body 22 having first and second line engaging means for holding and guiding the flexible line 23, and a rotatably connected rotor 24 (FIG. 2) having a housing 25 which has a first line receiving slot 26. In the embodiment shown, the first and second line engaging means comprise peripherally located first line retaining limb 28 and peripherally opposite second line retaining limb 30, having second line receiving slot 32 and third line receiving slot 34 respectively. Numerous other methods of holding and guiding the flexible line 23 can also be employed, such as traverse notches on line retaining limbs 28 and 30, or peripherally opposed hooks attached to body 22. The flexible line 23 passes through first line receiving slot 26 (FIG. 3), second line receiving slot 32 (FIG. 4), and third line receiving slot 34. Line receiving slots 26, 32, and 34 can be fabricated in varying widths to accommodate flexible lines 23 of different sizes or diameters.

A ratcheting means permits rotor 24 to rotate in one direction only relative to body 22. In the embodiment shown, the ratcheting means comprises a plurality of peripheral ratchet teeth 36 forming a ratchet wheel 38 that is integral with rotor 24. The ratcheting means further includes a pawl 40 that is integral with body 22. Pawl 40 can either be a separate assembly or can be fabricated as a part of body 22. In a variation, ratchet teeth 36 and ratchet wheel 38 can be located on body 22, and pawl 40 can be located on rotor 24. The number of ratchet teeth 36 located on the perimeter of ratchet wheel 38 determine the resolution of length adjustment. The greater the number of ratchet teeth 36, the smaller the increment of adjustment. Body 22 has a truncated portion 42 that exposes ratchet teeth 36. This permits the length controller 20 to be adjusted by manually turning ratchet wheel 38 from the side.

The length controller 20 can be fabricated in various sizes to accommodate any picture, mirror, or other hanging object. Also, the length controller 20 can be fabricated from any one of numerous plastics using injection molding techniques, or could be made of a stronger material such as metal for use with heavy hanging objects. One particularly useful application of the length controller 20 is to allow periodic compensation for flexible lines 23 that stretch under the continuous load of hanging objects.

FIG. 2 is a cross section view of the length controller 20 along the line 2—2 of FIG. 1. Rotor 24 is shown to include an axle 44 which is inserted into a centrally located circular bore 46 in body 22, the bore 46 is sized to snugly accept axle 44. Axle 44 enables rotation of rotor 24 relative to body 22. Axle 44 has a circumferential rib 52 which can engage either a first circumferential groove 48 or a second circumferential groove 50 in bore 46, thus holding axle 44 in place within bore 46. First circumferential groove 48 and second circumferential groove 50 are spaced a predetermined axial distance D apart, and are sized to snugly accept rib 52. In the shown ready for use configuration, rib 52 engages second groove 50. Rib 52 is fabricated from a resilient plastic, or the like, so that it can contract and then re-expand when moving from groove 50 to groove 48. A resilient protective membrane 54, fabricated from plastic or the like, covers the end of axle 44 and is attached to body 22 by plastic welding or adhesive.

FIG. 3 is a fragmented cross section view of housing 25, first line receiving slot 26 and ratchet wheel 38 along the line 3—3 of FIG. 1. A fourth line receiving slot 56 is oriented perpendicular to and intersects first line receiving slot 26 forming an L shape. Fourth line receiving slot 56 radially tapers from the view of FIG. 3 to intersect the axis of ratchet wheel 38 where the taper continues on the opposite side to the opposite end of the slot 26 where it appears as the mirror image of FIG. 3. The opposite end is also shown in FIG. 7. When rotor 24 is turned relative to body 22, the flexible line 23 is captured by line receiving slot 56, thus preventing the flexible line 23 from moving out of first line receiving slot 26 as shown in FIG. 6.

FIG. 4. is a fragmented view of the first line engaging means along the line 4—4 of FIG. 1. Flexible line 23 rests in second line receiving slot 32 of line retaining limb 28.

FIG. 5 is a cross section view of the length controller 20 along the line 2—2 of FIG. 1 showing activation of the ratchet disengaging means. Axle 44 is manually moved in direction 58 so that rib 52 vacates second groove 50 and engages first groove 48. The resulting axial movement of rotor 24 causes pawl 40 to disengage from ratchet wheel 38, therefore allowing rotor 24 to turn in either direction relative to body 22 thereby releasing the line tensioning force. Other methods of disengaging pawl 40 are also possible such as moving pawl 40 radially with respect to axle 44, moving pawl 40 axially along axle 44, or utilizing a gravity activated pawl 40 wherein pawl 40 engages or disengages depending upon the vertical orientation of the length controller 20. The ratchet wheel 38 is reengaged with pawl 40 by moving axle 44 manually opposite direction 58 so that rib 52 vacates first groove 48 and engages second groove 50.

FIG. 6. is a front view of the length controller 20 showing rotor 24 turned to apply tensioning force to the flexible line 23. In the shown embodiment, rotor 24 has been turned counterclockwise in direction 60, thus applying tensioning force to flexible line 23 causing the flexible line 23 to start to wind around rotor housing 25 thus reducing the effective length of the flexible line 23. The length L of first line receiving slot 26 determines the reduction in effective length that is achieved for a given angular rotation of rotor 24. The longer the slot, the greater the effective length reduction. For any slot length L, a rotor 24 angular rotation of 180° will produce an effective length reduction of approximately two times L.

FIG. 7 is an exploded view of the length controller 20, showing the protective membrane 54; body 22 having line retaining limbs 28 and 30, line receiving slots 32 and 34, and bore 46; pawl 40; and rotor 24 having housing 25, line receiving slot 26, axle 44, ratchet teeth 36, and ratchet wheel 38.

The length controller 20 is operated by inserting the flexible line 23 into first line receiving slot 26, second line receiving slot 32 in the first line engaging means, and third line receiving slot 34 in the second line engaging means; turning rotor 24 in the direction of the arrow 60 (FIG. 6) to decrease the effective length of the flexible line 23; and, releasing rotor 24. The length controller 20 is disengaged by activating the ratchet disengaging means (FIG. 5) to release rotor 24, thus permitting an increase in the effective length of the flexible line 23.

FIG. 8 is a fragmented view of a second embodiment of the first line engaging means, viewed in the same direction as FIG. 4. In the embodiment shown, the first line engaging means includes a first line retaining limb 28 having a first line receiving notch 29. Flexible line 23 rests in first line receiving notch 29. Second line retaining limb 30 has an identical second line receiving notch (not shown).

Figure 9:
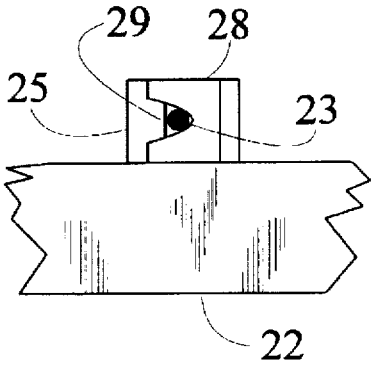
FIG. 9 is a fragmented view of a third embodiment of the first line engaging means, viewed in the same direction as FIG. 4.

FIG. 9 is a fragmented view of a third embodiment of the first line engaging means, viewed in the same direction as FIG. 4. In the embodiment shown, the first line engaging means includes a peripherally located first line receiving hook 31. Flexible line 23 rests in first line receiving hook 31. A second line receiving hook (not shown) is located peripherally opposite to first line receiving hook 31.

Figure 10:
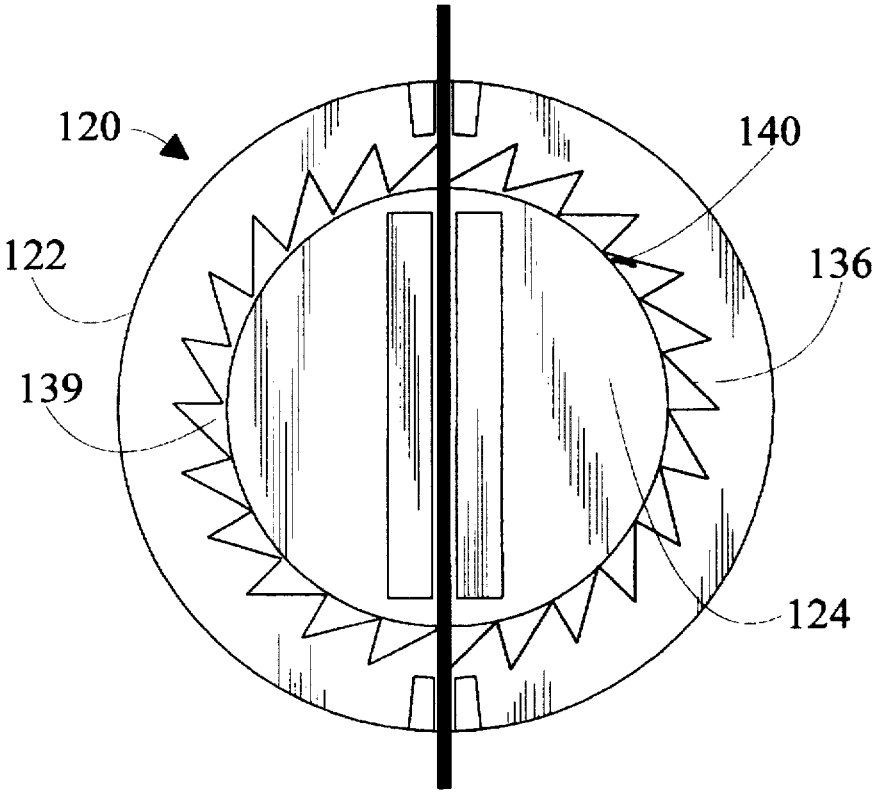
FIG. 10 is a front view of a second embodiment of the length controller.

FIG. 10 is a front view of a second embodiment of the length controller, generally designated as 120. In the embodiment shown, the ratcheting means includes a plurality of ratchet teeth 136 forming ratcheted cavity 139 which is integral with body 122, and pawl 140 which is integral with rotor 124. Pawl 140 cooperates with ratchet teeth 136.

Figure 11:
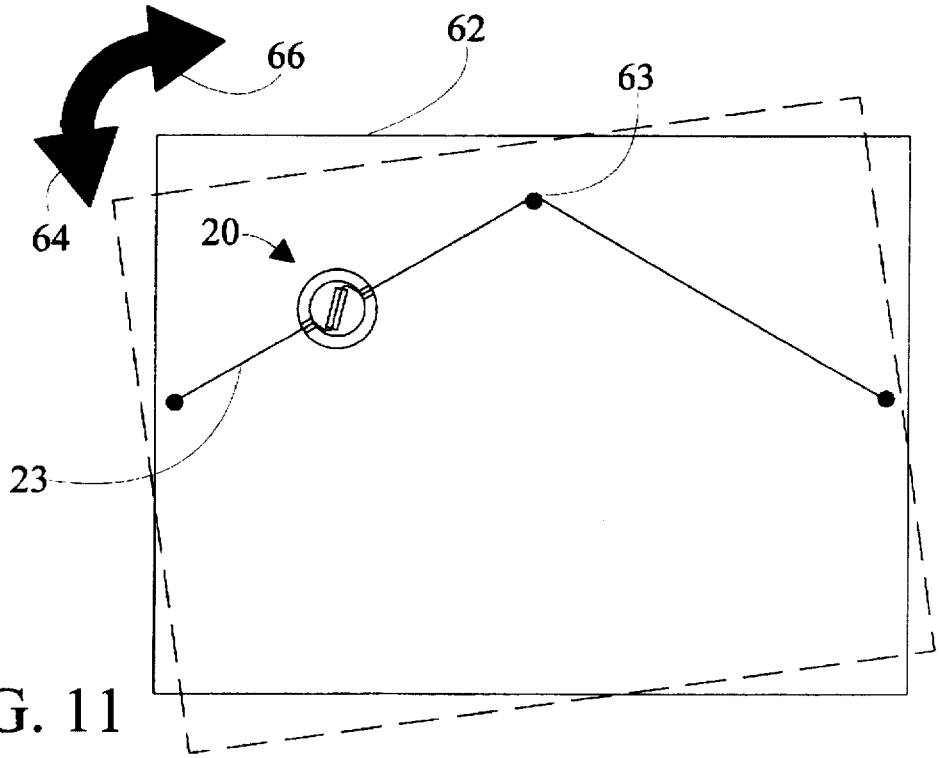
FIG. 11 is a view of the back of a tilted picture being leveled.

FIG. 11 is a view of the back of a hanging picture 62 that is hung from a hanger 63 connected to a supporting structure. The picture is tilted to the left as shown in the dotted outline because the length of line 23 on the left side of hanger 63 is longer than the length of the line on the right side. To level the picture, a length controller 20 is attached to the longer side and rotated to shorten the effective length of the line. This rotates the picture in a clockwise direction represented by arrow 66 until the picture is level as shown in the solid outline. If the left side of the line is shortened too much so the picture tilts to the right, the length controller can be released a little allowing the picture to rotate in the counterclockwise direction represented by arrow 68 until it is again level.

Figure 12:
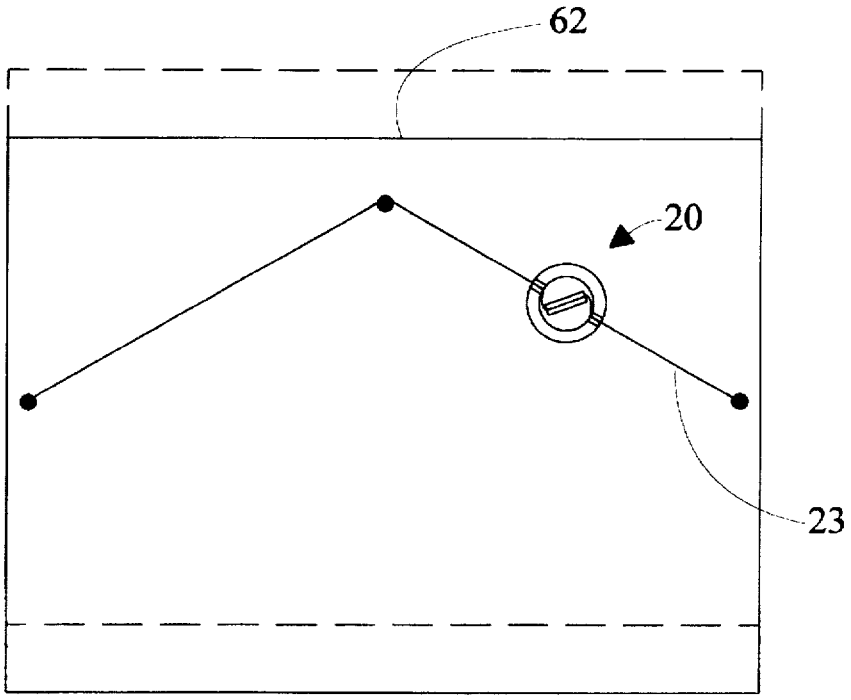
FIG. 12 is a view of the back of a picture being elevated.

FIG. 12 illustrates another use of the length controller 20 where it is used to raise or lower the entire picture on the hanger 63. This is done by rotating controller 20 to effectively shorten line 23. For example, if the picture is originally at the height represented by the solid outline and it is desired to raise the picture to the position represented by the dotted line, the controller is rotated shortening the line. At this point, the picture 62 will be tilted as in FIG. 11. The picture is then leveled by moving the picture and line 23 on the hanger 63 until the lengths of the line on either side of the hanger are equal making the picture level at the higher elevation. The length controller allows very small changes to be made in tilt or elevation which is particularly useful when two or more pictures are being hung close to each other.

Figure 13:
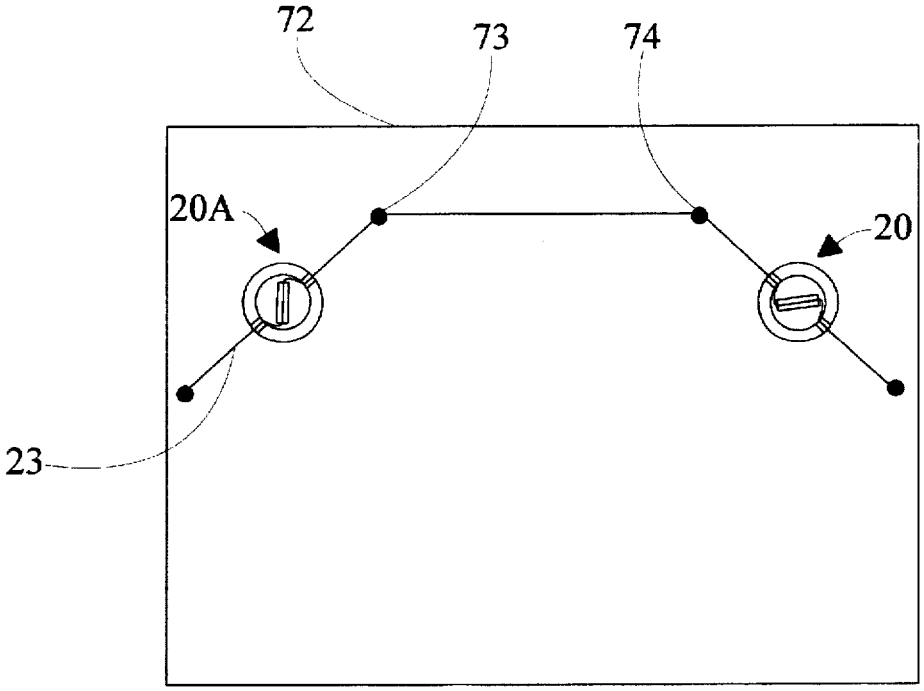
FIG. 13 is a view of a picture mounted on two hangers.

FIG. 13 is a view of the back of a hanging picture 72 showing two length controllers 20 attached to the flexible line 23 and two hangers 73 and 74 in the supporting structure. Additional hangers can be added between the two shown for exceptionally heavy pictures. The picture is leveled by decreasing the effective length of whichever side has the longer flexible line between the hanger and the picture. If, for example, the picture is tilted to the left, the controller 20A is turned lifting the left end. The other controller is not used. The picture is elevated by operating either of the controllers 20 to decrease the effective length of the flexible line and then sliding the flexible line on the hangers. The picture may also be elevated by operating both of the controllers to decrease the effective lengths of the flexible line outside both of the controllers. The flexible line then does not need to be slid on the hangers. Movement of the picture to the left and right is also possible by sliding the line 23 along the hangers 72, 73 because the picture no longer has to be balanced on a single hanger. The slight tilting that will result can be removed by then adjusting the controllers. If some of the flexible line is prewound on both of the length controllers prior to hanging the picture, the picture can be moved to the left or right by releasing line from one of the length controllers and winding the other. For example, to move to the right, length controller 20A is released slightly and controller 20 is wound up.

Figure 14:
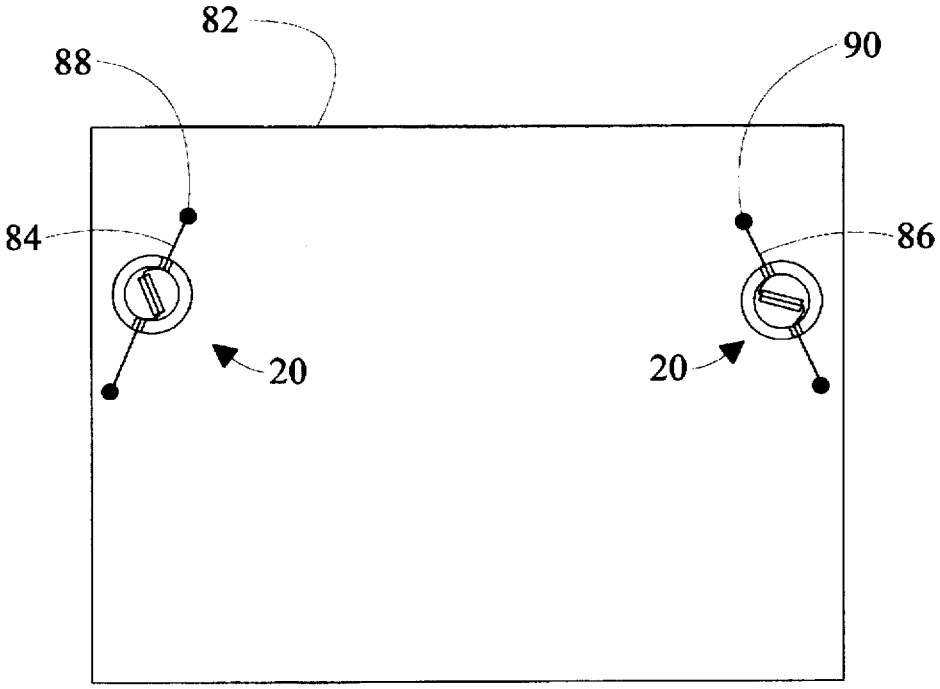
FIG. 14 is a view similar to FIG. 13 with two lines.

FIG. 14 is similar to FIG. 13. In this version, the picture 82 is suspended from two flexible lines 84, 86 attached to two hangers 88, 90. A length controller 20 is attached to each line. Tilt, elevation, and slight left to right orientation are adjusted by adjusting the controllers 20.

Figure 15:
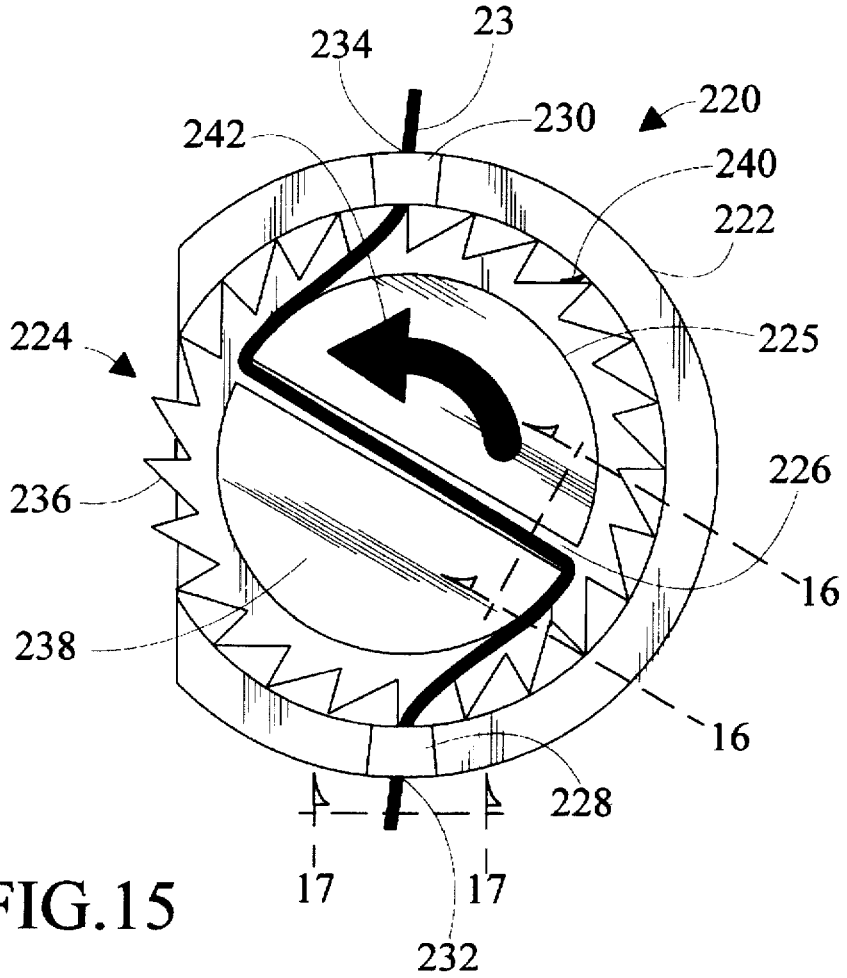
FIG. 15 is a front view of a third embodiment of the length controller.

FIG. 15 is a front view of a third embodiment of the length controller generally designated as 220. The length controller 220 is substantially the same as the controller 20 of FIG. 1 having a substantially disc shaped body 222 with first and second line engaging means for holding and guiding the flexible line 23 and a rotatably connected rotor 224 having a housing 225 which has a first line receiving slot 226. The first and second line engaging means comprise peripherally located first line retaining limb 228 and peripherally opposite second line retaining limb 230 having second line receiving slot 232 (FIG. 17) and an identically appearing third line receiving slot, respectively. The flexible line 23 passes through first line receiving slot 226, second line receiving slot 232 (and FIG. 17), and the third line receiving slot 234. The ratcheting means of this embodiment is the same as the ratcheting means of the length controller 20 having a plurality of peripheral ratchet teeth 236 forming a ratchet wheel 238 that is integral with rotor 224 and a pawl 240 that is integral with body 222.

Two changes are made in this embodiment. The first is the construction of the housing 225 with a circular configuration as shown in FIG. 15 instead of the rectangular configuration of the housing 25 shown in FIG. 1. Faster pulling of the line 23 is then possible when the ratchet wheel 224 is turned a given number of degrees in the direction indicated by the arrow 242 because the circumference of the housing 225 is greater than the perimeter of the housing 25. More uniform pulling is also possible due to the fact that the housing 225 pulls the same at all positions because it is a circle whereas the housing 25 does not pull uniformly because it is a rectangle. The second change occurs in the configurations of the first, second, and third line receiving slots. In the present embodiment, the first receiving slot 226 in the rotor 224 has smooth sides unlike the undercut side of the slot 26 in the first embodiment 20 shown in FIG. 3. The second receiving slot 232 (FIG. 17) and third receiving slot 234 instead enter the left sides of the first and second retaining limbs 228 and 230, respectively, and are oriented perpendicular to the first receiving slot 226 thereby capturing the line 23 when the rotor 224 is turned as shown in FIG. 15. The undercut of the first receiving slot 26 of the first embodiment may also be retained if desired.

Figure 16:
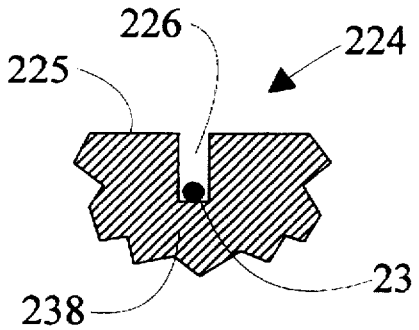
FIG. 16 is a fragmented cross section view of the first line receiving slot and the ratchet wheel along the line 16—16 of FIG. 15; and, FIG. 17 is a fragmented view of the first line engaging means along the line 17—17 of FIG. 15 without the rotor turned similar to FIG. 4.

FIG. 16 is a fragmented cross section view of the first line receiving slot 226 and the ratchet wheel 224 along the line 16—16 of FIG. 15. The sides of the slot 226 are perpendicular to the bottom. In comparison in the first embodiment shown in FIG. 3, the left side is undercut by a fourth line receiving slot 56.

Figure 17:
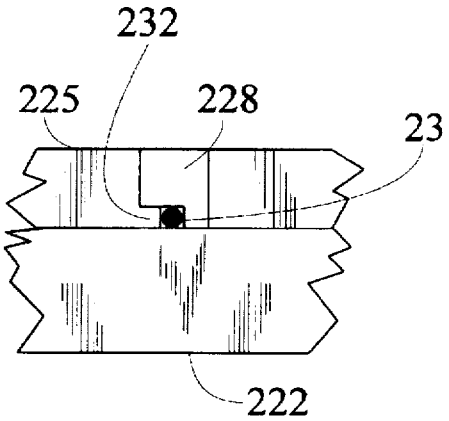

FIG. 17 is a fragmented view of the first line engaging means along the line 17—17 of FIG. 15 without the rotor 224 turned. The view of FIG. 15 is similar to FIG. 4 and shows the housings 25, 225 and bodies 22, 222 in the same relative positions. Flexible line 23 rests in second line receiving slot 232 of line retaining limb 228. The second line receiving slot 232 enters first line retaining limb 228 from the left side and is perpendicular to the first line receiving slot 226. The slot 232 thereby captures the flexible line 23 when the housing 225 is turned to the right as shown in FIG. 15. The second line retaining limb 230 (FIG. 15) appears exactly the same as the view of FIG. 17 when seen from the opposite side of the length controller 220 looking toward the center.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A length controller for adjusting an effective length of a flexible line, wherein the flexible line is fixed at both ends comprising:

a body having first and second line engaging means for holding and guiding the flexible line, said first line engaging means includes a first line retaining limb disposed on a periphery of said body, said first line retaining limb having a second line receiving slot, said second line engaging means including a second line retaining limb disposed opposite said first line engaging means on said periphery, said second line retaining limb having a third line receiving slot;

a rotor rotatably connected to said body, said rotor having a first line receiving slot;

a ratcheting means permitting said rotor to rotate in one direction only relative to said body; and, a ratchet disengaging means for disengaging said ratcheting means and permitting said rotor to rotate in either direction relative to said body, wherein said ratchet disengaging means includes:

an axle integral with said rotor having a circumferential rib;

a circular bore integral with said body sized to snugly accept said axle, said bore having a first circumferential groove and a second circumferential groove located a predetermined axial distance from said first circumferential groove, said first and second grooves sized to snugly accept said rib;

wherein said axle is manually positionable within said circular bore so that said rib is accepted by either said first circumferential groove or by said second circumferential groove.

2. The length controller of claim 1, wherein said ratcheting means includes:

a plurality of peripheral ratchet teeth forming a ratchet wheel, said ratchet wheel integral with said rotor;

a pawl integral with said body; and, said ratchet teeth cooperating with said pawl.

3. The length controller of claim 1, wherein said ratcheting means includes:

a plurality of peripheral ratchet teeth cooperating with a pawl;

said pawl integral with said rotor.

4. The length controller of claim 1, said rotor further having a fourth line receiving slot, said fourth line receiving slot oriented perpendicular to and intersecting said first line receiving slot thereby forming an L shape therewith, said first line receiving slot and said fourth line receiving slot having longitudinal axes parallel to each other and having axes extending in a direction of their respective depths perpendicular to each other.

* * * * *